US007118469B1

(12) United States Patent
Lee

(10) Patent No.: US 7,118,469 B1
(45) Date of Patent: Oct. 10, 2006

(54) ABRASIVE PAD, METHOD AND SYSTEM FOR MAKING AN ABRASIVE PAD

(76) Inventor: Charley Lee, 5458 Hunt Club Dr., Virginia Beach, VA (US) 23462

( * ) Notice: Subject to any disclaimer, the term of this patent is extended or adjusted under 35 U.S.C. 154(b) by 0 days.

(21) Appl. No.: 11/177,669

(22) Filed: Jul. 7, 2005

(51) Int. Cl.
*B24D 11/00* (2006.01)
*B22D 19/00* (2006.01)
*B22D 19/04* (2006.01)
*B22D 5/00* (2006.01)

(52) U.S. Cl. ..... 451/527; 451/528; 451/529; 249/83; 249/90; 249/91

(58) Field of Classification Search ..... 451/527–529; 249/83, 90, 91
See application file for complete search history.

(56) References Cited

U.S. PATENT DOCUMENTS 2,252,683 A * 8/1941 Albertson ..... 51/298
4,588,420 A * 5/1986 Charvat ..... 51/298
5,232,470 A * 8/1993 Wiand ..... 51/295
5,525,100 A * 6/1996 Kelly et al. ..... 451/527
5,681,362 A * 10/1997 Wiand ..... 51/298
6,261,156 B1 * 7/2001 Johnson et al. ..... 451/41
6,371,842 B1 * 4/2002 Romero ..... 451/540
2003/0181144 A1 * 9/2003 Mujumdar et al. ..... 451/41

* cited by examiner

*Primary Examiner*—Lee D. Wilson
*Assistant Examiner*—Bryan Muller
(74) *Attorney, Agent, or Firm*—Bradley D. Goldizen; Goldizen & Associates

(57) ABSTRACT

An abrasive pad having dots of abrasive material disposed thereon includes a central alignment hole. The abrasive pad is formed by slipping a backing pad having a central alignment hole onto an alignment stud that extends from a support surface through the central alignment hole. A mold having a plurality of fill holes and an alignment hole is then placed against the backing pad such that a portion of the alignment stud extends into the mold alignment hole. A mixture of abrasive material is deposited into the fill holes. Heat is applied and the mold is removed. The abrasive material is allowed to cure to create an abrasive pad having abrasive dots.

12 Claims, 6 Drawing Sheets

ABRASIVE PAD, METHOD AND SYSTEM FOR MAKING AN ABRASIVE PAD

BACKGROUND OF THE INVENTION

The invention is generally directed to an abrasive pad and a method and system for making it. More specifically, the invention is directed towards an abrasive pad that is produced by providing a backing pad comprised of a fibrous material and depositing an abrasive mixture thereon in selected regions.

The present invention overcomes several problems that are encountered with the production and use of prior art sanding and polishing pads. Many abrasive pads are made using a resin powder and an abrasive material that are mixed together and poured into a steel mold. The mold is placed into a heated pressing machine where it is heated to approximately one-hundred forty degrees Celsius (140° C.) and placed under pressure for at least five minutes (5 min.). The steel mold is removed from the press and the finished pad is removed from the mold.

One drawback with the existing art is that several steel molds are necessary to ensure that cross contamination of the different sized particles does not occur. Different sized particles are necessary for producing various grits of abrasive pads. The use of a steel mold requires that the percentage of resin to abrasive must remain below fifty-percent (50%).

Another drawback with prior art abrasive pads is that when used, debris quickly gums up or clogs the pads. Most often the debris is dust or fine particles dislodged during the sanding process from the material upon which the abrasive pad is being used to perform sanding. This gumming or clogging of the pads increases heat that tends to lead to a breakdown of an adhesive that secures the abrasive material causing it to prematurely release from the pad. This premature release from the pad tends to cause the pads to be used more often. Moreover, the abrasive, rough surface of the pad fills with debris causing it to become smooth and thereby decreasing the effectiveness of the pads. To overcome this, some abrasive pads include grooves and ridges of adhesive material spaced far enough apart to dissipate heat and debris. However, the prior art pads are relatively ineffective and fall short of overcoming these drawbacks.

The present invention is an abrasive pad that overcomes the aforementioned difficulties associated with manufacturing and using prior art abrasive pads. To that end, the present invention is an abrasive pad which is easily produced and exhibits superior heat and debris dissipating qualities when used. Another added benefit of the present invention is that the fibrous support pad provides a superior surface to which the abrasive material may adhere without premature separation of the abrasive material as in the prior art.

BRIEF SUMMARY OF THE INVENTION

The present invention is an abrasive pad for sanding, polishing and smoothing surfaces. The abrasive pad includes a backing pad comprising a fibrous material and having a central alignment hole used for manufacturing purposes. The backing pad is die cut from a piece of larger fibrous material. Preferably, the backing pad comprises one or more selecting from a group of material consisting of nylon, polyester, cotton, nomex, Krylon, poly acetate, acrylic-nitrils, spun yarn or filament, water resistant paper, non-woven textile, or machine piled textile including hook and loop material or a cotton towel.

The backside of the material is laminated with a high temperature and water resistant laminate or coated with polyurethane. The material is then die cut into circular shapes to create a backing pad. Preferably, the backing pad has an outer diameter of 100 mm. An inner hole, preferably having a circular shape, is simultaneously cut from the center of each piece of circularly-shaped material. If the central hole is cut in a circular shape it is preferably 20 mm in diameter. It should be noted that a variety of geometric shapes may be used to punch the inner hole.

A support material, typically a plastic, paper, wood or other such material is provided. Preferably, the support material is rigid and is large enough to accommodate several backing pads when placed on the support material side-by-side. Typically, the support material is 1–6 mm thick depending on the height of the abrasive compound and can accommodate 2 to 20 pads.

Next an alignment stud material is provided. Preferably, the alignment stud material comprises rubber, plastic, wood or sponge that is between 1–6 mm thick. This material is laminated with a high temperature and water resistant adhesive laminate having a release paper on one side thereof. Alignment studs are then die cut from the material in a substantially, complementary shape and size to the central hole in the backing material.

A template mold having alignment holes and abrasive material fill holes is die cut for creating a plurality of abrasive pads simultaneously. The fill holes may be punched in a circular fashion about the alignment holes at desired distances. Preferably, a four pad mold works best because it is easier to handle. The mold is preferably manufactured from a rubber, plastic, wood, paper or metal sheet.

The alignment studs are then fixed onto the support material by removing the release paper from the adhesive laminate. The backing pad is centered on one of the alignment studs. The alignment stud is longer than the thickness of the backing pad to extend all the way through the central hole in the abrasive pad. The alignment stud holes of the mold are then centered on the alignment studs. An abrasive mixture is created by preferably combining silicone carbide, diamond powder or other abrasive material with resin. The abrasive mixture is then poured into the filling holes and the mold is removed from the pad assembly leaving abrasive material on a portion of the backing pad in areas corresponding to the fill holes. The abrasive pad is then dried for eight hours at 60–90 degrees Celsius. Afterward, the abrasive pad is placed in an oven at one-hundred forty degrees Celsius (140° C.) for five minutes to produce a novel abrasive pad having dot-shaped or raised areas of abrasive material.

The following resins can be used to create the abrasive dot: Phenolic resin, Urea resin, Urea Melamine resin, Epoxy resin, Polyester resin, or Polyurethane resin. The preferable resin is Melamine compound resin, Phenolic compound resin or epoxy resin. Various resins may be used in concert with the abrasive material. A preferable Melamine compound resin comprises 64 g of Melamine resin powder, 75 g polyvinyl alcohol, 19.2 g of acrylic copolymer, and 278.28 g of water or their related ratios.

A phenolic compound resin is created by combining 500 g of phenol with 50 g of polyamide and allowing the mixture to rest for 8–12 hours. Next, 755 g formaldehyde are mixed at 77° C. for 3–4 hours. 82 g of polyvinyl alcohol is mixed with 246 g of water. Five percent of the total weight of sodium hydroxide is added as a catalyst and agitated for 4–5 hours. An epoxy resin comprising 50 grams of Biphenol A and 50 grams of Tri-Hexamethylene Diamine may be provided in the abrasive mixture.

In one embodiment, it is an object of the invention to provide an abrasive pad that includes cylindrical abrasive regions. Other areas of the abrasive pad are devoid of any abrasive materials to advantageously expose a fibrous surface of a backing pad.

It is an object of the invention to teach a manufacturing process for abrasive pads that require neither a steel mold nor a hot press for producing abrasive pads.

It is another object of the invention to teach a manufacturing process for abrasive pads that reduces production costs and creates abrasive pads having abrasive materials deposited thereon that include a higher percentage of abrasive materials to adhesive material than those of the prior art.

It is an object of the invention to produce an abrasive pad which operates more efficiently, dissipates heat more readily and is more durable than existing prior art abrasive pads.

It is a further object of the invention to provide an abrasive pad having abrasive material deposited on a backing pad far enough apart to allow increased airflow through the pad when in use.

It is a further object of the invention to provide an abrasive pad having a backing pad that includes a fibrous material which fibers produce a sweeping action to move debris away from the pad when in use. Moving the debris away from the pad prevents debris from building up on the surface of the pad to reduce the efficiency of the pad.

It is another object of the invention to provide an abrasive pad that exhibits superior wear qualities over the existing prior art devices.

Additional objects and advantages of the invention will be set forth in part in the description that follows, and in part will be obvious from the description, or may be learned from practicing the invention. The objects and advantages of the invention will be obtained by means of instrumentalities in combinations particularly pointed out in the appended claims.

DETAILED DESCRIPTION OF THE INVENTION

Figure 1A:
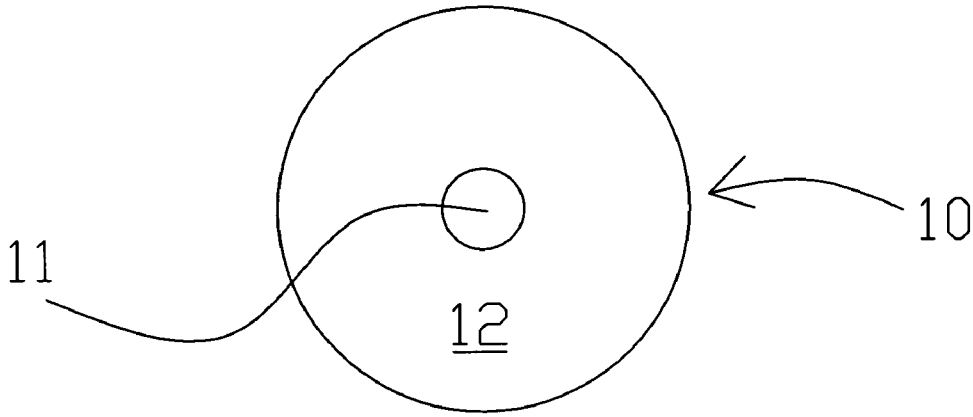
FIG. 1A is a plan view of a backing pad having an alignment hole.
Figure 1B:
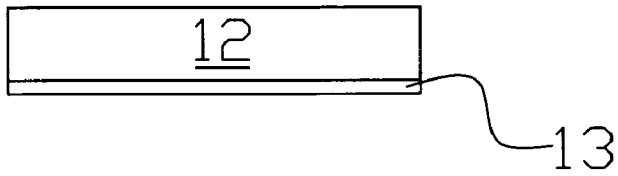
FIG. 1B is an elevation view of the backing pad.

FIGS. 1A and 1 B show a backing pad 10 formed from a sheet of fibrous material (not shown). Preferably, the backing pad comprises one or more types of material comprising: nylon, polyester, cotton, nomex, poly acetate, acrylic-nitrils, spun yarn or filament, water resistant paper, non-woven textile, or machine piled textile including hook and loop material or a cotton towel. The backing pad 10 is typically die cut from the larger sheet of material to include a central hole 11. Abrasive material 60 adheres to fibrous backing material 12 as discussed hereinafter. One side of the backing pad 10 is laminated with a high temperature and water resistant laminate 13. This lamination process may occur either before or after the sheet of material has been cut into pads 10. Polyurethane may also be used in place of the laminate 13.

Figure 2:
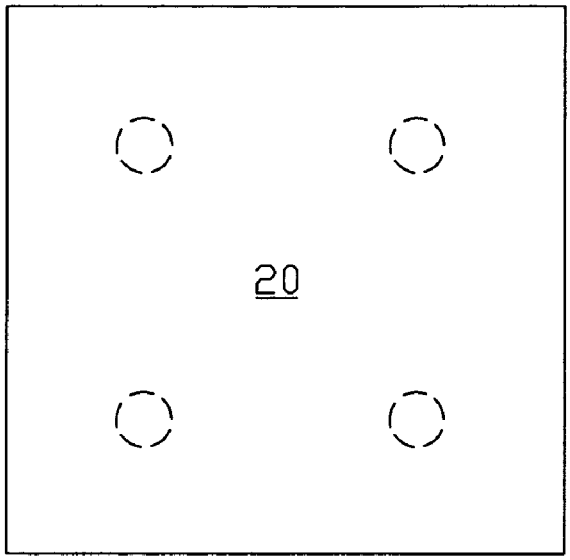
FIG. 2 is a plan view of support surface upon which the backing pad is placed during the manufacturing process.

FIG. 2 depicts a support material 20 upon which the abrasive pad 1 is formed. Broken or dashed lines indicate a region where alignment studs are affixed to create the abrasive pad 1. Preferably, the support material is rigid and is large enough to accommodate several backing pads when placed on the support material side-by-side. For ease in understanding the invention, the support material 20 of FIG. 2 shows only enough space to accommodate four pads 10. Typically, the support material is 1–6 mm thick depending on the height of the abrasive compound and can accommodate 2 to 20 pads.

Figure 3A:
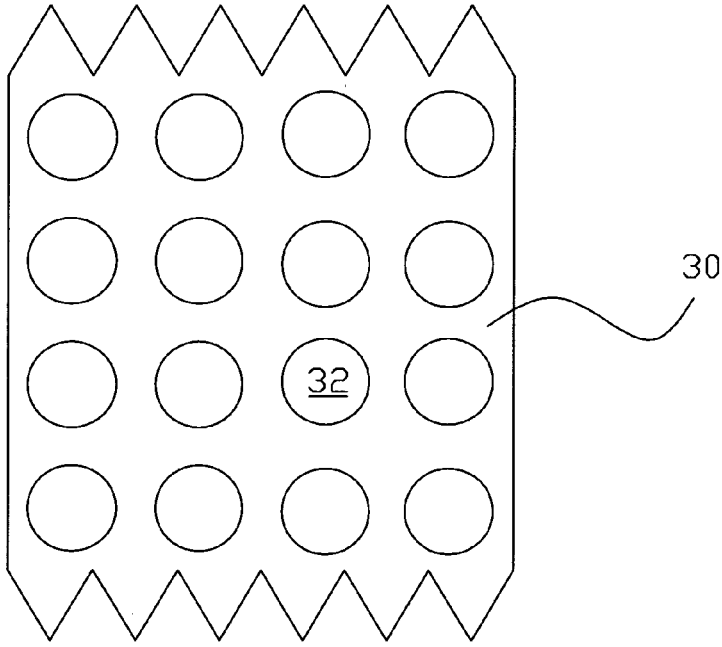
FIG. 3A is a plan view of a material for making an alignment stud.
Figure 3B:
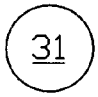
FIG. 3B is a plan view of an alignment stud.
Figure 3C:
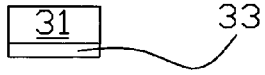
FIG. 3C is an elevation view of the alignment stud shown in FIG. 3B.

FIGS. 3A–3C shows a strip of material 30 from which a plurality of alignment studs 31 are formed. Preferably, the alignment stud material 30 comprises rubber, plastic, wood or sponge that is between 1–6 mm thick and should be thicker than the backing material from which the backing pads are cut. This material is laminated with a high temperature and water resistant adhesive laminate 33 having a release paper on one side thereof. Alignment studs 31 are then die cut from the material in a substantially, complementary shape and size to the central hole in the fibrous backing material 12.

Figure 4A:
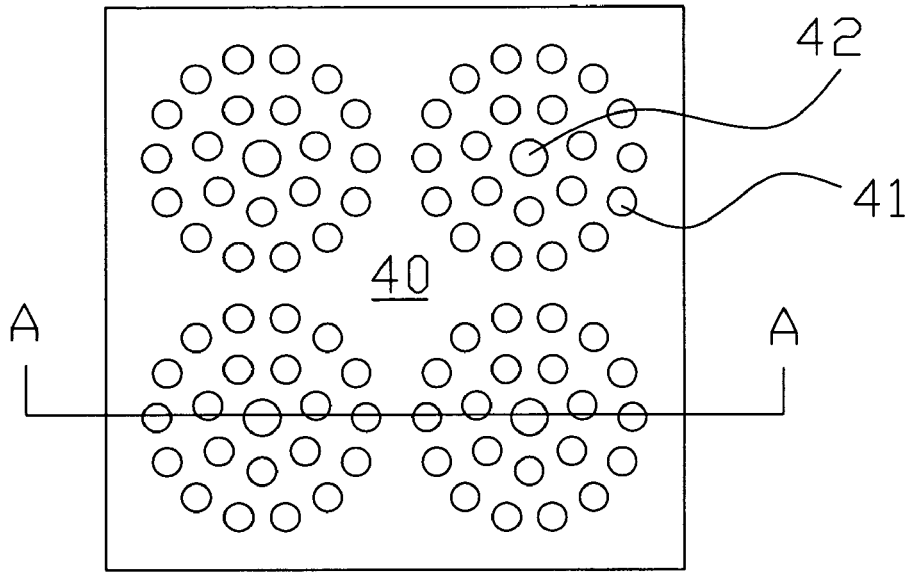
FIG. 4A is a plan view of a mold into which an abrasive material is deposited for forming abrasive regions on the backing pad.
Figure 4B:
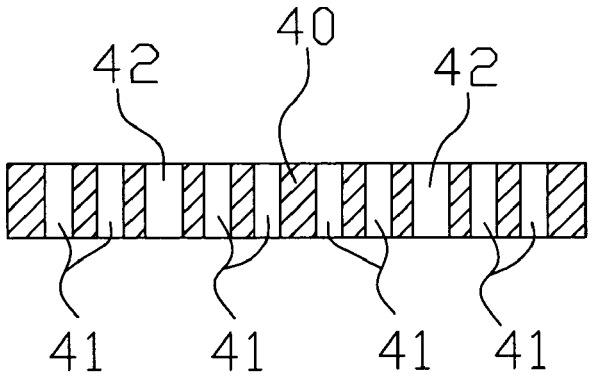
FIG. 4B is a cross section view of FIG. 4A taken from line A—A.
Figure 8A:
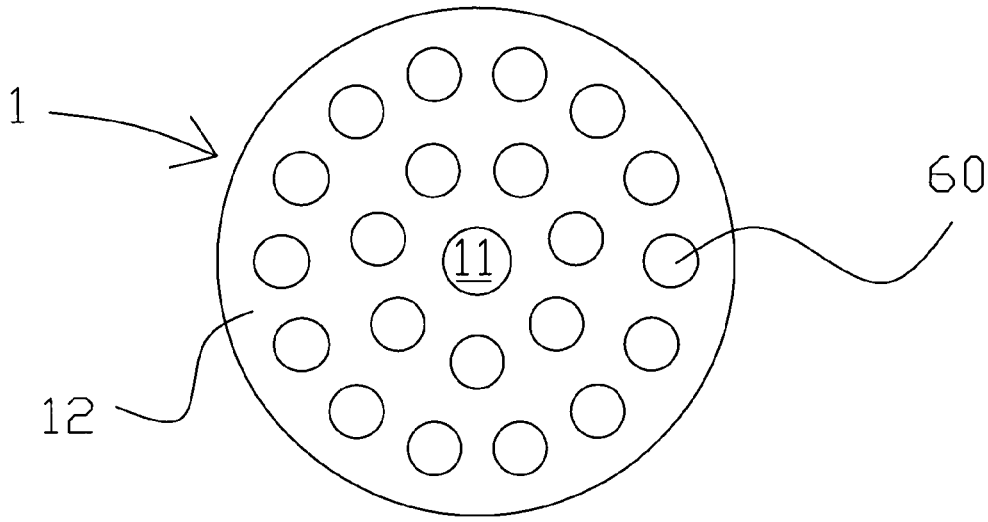
FIG. 8A is a plan view of the abrasive pad produced by the method of the instant invention.

FIGS. 4A and 4B show a mold 40 used for producing the abrasive pad 1. Mold 40 comprises fill holes 41 into which an abrasive mixture of material is deposited. The fill holes 41 provide support for the raised abrasive regions 60, as shown in FIG. 8A. A plurality of fill holes 41 are formed in a generally circular fashion, around an alignment holes 42, as shown. In FIG. 4A, the mold 40 comprises four alignment holes 42 for producing four abrasive pads 1 during a single run of the manufacturing process.

Figure 5A:
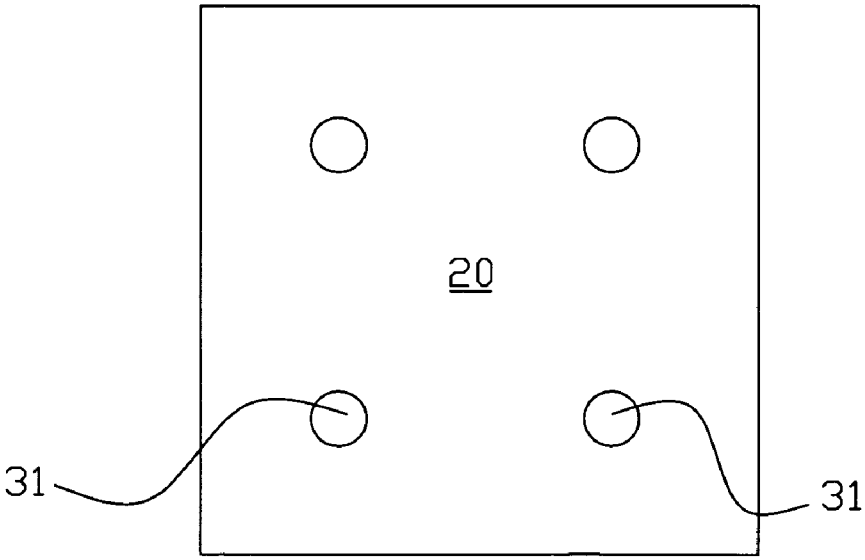
FIG. 5A is a plan view of support surface shown in FIG. 2 and having alignment studs attached thereto.
Figure 5B:
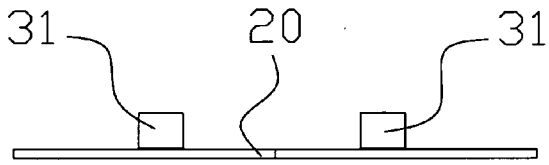
FIG. 5B is an elevation view of the support surface and aligning studs of FIG. 5A.

FIGS. 5A and 5B are views of the support material 20 on which a plurality of alignment studs 31 are affixed. A release paper from the laminate 33 is removed to allow access to an adhesive region of laminate 33. Alignment studs 31 are placed in a proper position on support material 20 as shown.

Figure 6:
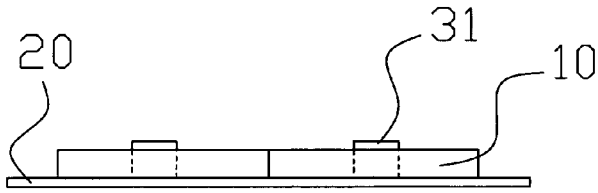
FIG. 6 is an elevation view showing two of the backing pads arranged on the support surface and having the alignment stud extending into the alignment hole.
Figure 7:
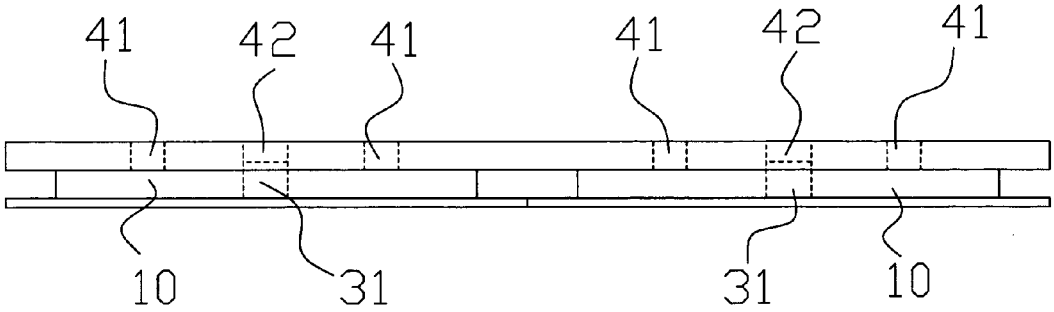
FIG. 7 is an elevation view showing a portion of the alignment stud extending through the alignment holes of the pads and into the alignment holes of the mold.

In FIG. 6, a central hole 11 in one of the backing pads 10 is aligned with an alignment stud 31. Backing pad 10 is then pushed downward against support material 20 such that alignment stud 31 protrudes from the central hole 11, as shown.

Figure 8B:
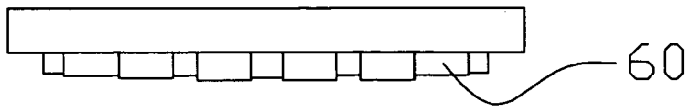
FIG. 8B is an elevation view of the abrasive pad of FIG. 8A.

Next, the alignment holes 42 of mold 40 are aligned with alignment studs 31 and the mold 40 is forced towards the pads 10 such that a portion of alignment stud 31 extends into alignment holes 42. A mixture of abrasive material such as silicone carbide, diamond powder or other abrasive material is mixed with a resin. The ratio of resin to abrasive can be from 30–70% depending on the desired quality. The fill holes 41 of the mold 40 are filled with the resin and abrasive mixture. The mold is then removed and the pads are allowed to dry for eight hours at 60–90 degrees Celsius to create an abrasive pad 1 having raised abrasive regions 60, as shown in FIGS. 8A and 8B. Next, the abrasive pad 1 is subjected to 140 degrees Celsius for 4–5 minutes.

It is to be understood that the invention is not limited to the exact construction illustrated and described above. Various changes and modifications may be made without departing from the spirit and the scope of the invention as defined in the following claims.

I claim:

1. An abrasive pad for sanding, polishing and smoothing surfaces, said abrasive pad comprising:

a backing pad having a front side and a backside comprised of a fibrous material, said backing pad having a central alignment hole and being die cut from a larger piece of fibrous material;

a plurality of projections of an abrasive material fastened to and extending from the front side of backing pad, said plurality of projections being created by depositing abrasive materials into fill holes in a template mold; and, wherein the projections are comprised of a Melamine compound resin ratio comprising 64 g of Melamine resin powder, 75 g polyvinyl alcohol, 19.2 g of acrylic copolymer, and 278.28 g of water.

2. The abrasive pad of claim 1 wherein the backing pad comprises one or more materials selected from a group of materials consisting of nylon, polyester, cotton, nomex, Krylon, poly acetate, acrylic-nitrils, spun yarn or filament, water resistant paper, non-woven textile, and machine piled textile including hook and loop material.

3. The abrasive pad of claim 1 wherein the backside of the backing pad comprises a water resistant laminate or is coated with polyurethane.

4. The abrasive pad of claim 1 wherein the backing pad has an outer diameter of 100 mm.

5. The abrasive pad of claim 1 wherein the central hole is cut in a circular shape with a diameter of 20 mm.

6. The abrasive pad of claim 1 wherein the projections comprise one or more resins selected from a group consisting of: Phenolic resin, Urea resin, Urea Melamine resin, Epoxy resin, Polyester resin, and Polyurethane resin.

7. The abrasive pad of claim 1 wherein the projections comprise an abrasive mixture created by preferably combining silicone carbide, diamond powder or other abrasive material with resin.

8. The abrasive pad of claim 1 wherein the projections comprise an abrasive mixture created by an abrasive material with resin.

9. The abrasive pad of claim 8 wherein the abrasive powder consists of one or more materials selected from a group consisting of silicone carbide and diamond powder.

10. A system for creating an abrasive pad comprising:

a rigid support material large enough to accommodate several backing pads when the backing pads are placed on the support material side-by-side;

at least one alignment stud affixed to the rigid support material;

a backing pad having an alignment hole through which the alignment stud extends when the backing pad is deposited onto the rigid support material;

a template mold having alignment holes and abrasive material fill holes, said alignment stud extending through the alignment hole in the template mold;

an abrasive material deposited in the abrasive material fill holes; and, wherein said alignment studs comprise a sheet of adhesive and a release paper.

11. The system of claim 10 wherein said template mold consists of one or more materials selected from a group consisting of rubber, plastic, wood, paper and metal sheet.

12. The system of claim 10 wherein the abrasive mixture consists of one or more materials selected from a group consisting of silicone carbide, diamond powder and resin.

* * * * *